US009387490B2

(12) United States Patent
Dong et al.

(10) Patent No.: US 9,387,490 B2
(45) Date of Patent: Jul. 12, 2016

(54) METHOD FOR IMPROVING SELECTIVITY AND RECOVERY IN THE FLOTATION OF NICKEL SULPHIDE ORES THAT CONTAIN PYRRHOTITE BY EXPLOITING THE SYNERGY OF MULTIPLE DEPRESSANTS

(71) Applicant: VALE S.A., Rio de Janeiro (BR)

(72) Inventors: Jie Dong, Mississauga (CA); Manqiu Xu, Mississauga (CA)

(73) Assignee: VALE S.A., Rio de Janeiro (BR)

( * ) Notice: Subject to any disclaimer, the term of this patent is extended or adjusted under 35 U.S.C. 154(b) by 462 days.

(21) Appl. No.: 13/862,117

(22) Filed: Apr. 12, 2013

(65) Prior Publication Data

US 2014/0305848 A1 Oct. 16, 2014

Related U.S. Application Data

(60) Provisional application No. 61/623,459, filed on Apr. 12, 2012.

(51) Int. Cl.

| | |
|---|---|
| ***B03D 1/02*** | (2006.01) |
| ***B03D 1/06*** | (2006.01) |
| ***B03D 1/016*** | (2006.01) |
| ***B03D 1/018*** | (2006.01) |
| ***B03D 1/01*** | (2006.01) |
| ***B03D 1/012*** | (2006.01) |
| ***B03D 1/014*** | (2006.01) |

(52) U.S. Cl.

CPC *B03D 1/01* (2013.01); *B03D 1/012* (2013.01); *B03D 1/014* (2013.01); *B03D 1/016* (2013.01); *B03D 1/018* (2013.01); *B03D 1/06* (2013.01); *B03D 2201/02* (2013.01); *B03D 2201/06* (2013.01); *B03D 2203/02* (2013.01)

(58) Field of Classification Search

CPC ..... B03D 1/01; B03D 1/06; B03D 1/016; B03D 1/018; B03D 1/02

See application file for complete search history.

(56) References Cited

U.S. PATENT DOCUMENTS

| | | | | |
|---|---|---|---|---|
| 4,514,292 | A * | 4/1985 | Burdick | 209/167 |
| 5,411,148 | A * | 5/1995 | Kelebek et al. | 209/166 |
| 8,221,709 | B2 * | 7/2012 | Gargulak et al. | 423/26 |

* cited by examiner

*Primary Examiner* — Thomas M Lithgow

(74) *Attorney, Agent, or Firm* — Arent Fox LLP

(57) ABSTRACT

A method of using the synergy of multiple depressants to improve the depression of iron sulphide without compromising the recovery of the valuable sulphide minerals in the flotation of non-ferrous metal sulphides, while reducing or eliminating the use of environmentally problematic chemicals such as polyamines. The method has significant economic and environmental benefits. The multiple depressants comprise at least one organic polymer, at least one sulphur-containing compound and/or at least one nitrogen-containing organic compound.

22 Claims, 14 Drawing Sheets

METHOD FOR IMPROVING SELECTIVITY AND RECOVERY IN THE FLOTATION OF NICKEL SULPHIDE ORES THAT CONTAIN PYRRHOTITE BY EXPLOITING THE SYNERGY OF MULTIPLE DEPRESSANTS

This application claims priority from U.S. Patent Application No. 61/623,459, titled "A Method for Improving Selectivity and Recovery in the Flotation of Nickel Sulphide Ores that Contain Pyrrhotite by Exploiting the Synergy of Multiple Depressants," filed on Apr. 12, 2012, and which is incorporated herein by reference in its entirety.

FIELD OF INVENTION

The present disclosure relates to a method of selective froth flotation of sulphide minerals using a combination of depressant reagents.

BACKGROUND

Sulphide mineral flotation has been practiced since the early $20^{th}$ century. Its industrial importance is well recognized as the concentrates from flotation can be more economically smelted and refined to provide primary metals. Froth flotation is a process to selectively separate value minerals from waste gangue materials through utilizing the differences in surface hydrophobicity. In general, the flotation process involves the grinding of crushed ore in a dense slurry to liberation size, followed by its conditioning with different reagents in a suitable dilute pulp. The reagents include collectors, depressants, frothers, modifiers, etc. Collectors render the surface of desired minerals hydrophobic by physical/chemical adsorption, which facilitates the attachment of air bubbles that cause the mineral particles to float to the surface of the slurries and form a stabilized froth which is collected for further treatment. Depressants have the reverse action to collectors, causing the surface of undesired mineral particles to become hydrophilic by adsorbing hydrophilic components or by removing the active sites for the collector's adsorption, thus allowing the particles to remain in the tailings fraction. Frothers help to stabilize air bubbles of suitable sizes in the slurry in order to capture and transfer particles to the froth zone. Modifiers are usually used for pH control. The various schemes of froth flotation that are employed are generally quite complex in order to maximize grade and recovery of the valuable minerals present and to maximize rejection of rock and sulphide minerals of little commercial value.

In the processing of sulphide ores for the recovery of non-ferrous pay metals, the common value minerals treated include pentlandite and millerite, chalcopyrite and chalcocite and bornite, galena, and sphalerite for the metals Ni, Cu, Pb and Zn respectively. However, these value minerals are naturally associated with iron sulphides, namely pyrrhotite, pyrite, and marcasite, which have no commercial value and are considered as sulphide gangues. Selective rejection of iron sulphides in flotation can significantly improve the economic value of the concentrate and also reduce the $SO_2$ emissions at smelters where the iron sulphides are significant contributors to these gaseous emissions. However, pyrrhotite rejection is challenging. It not only relates to the abundance of pyrrhotite in the ore, but also to the crystal structure of pyrrhotite (i.e. monoclinic, hexagonal or troilite). Furthermore, pyrrhotite is intimately associated with other minerals, primarily with pentlandite. Selective depression of pyrrhotite without compromising the recoveries of Cu and Ni during flotation is a key to building commercial value in an industrial mineral processing plant.

U.S. Pat. No. 5,074,993 describes a method of flotation of sulphides wherein pyrrhotite is depressed by use of a water-soluble polyamine in an amount >50 g/mt of the ground mineral mixture. The water-soluble polyamine is preferably diethylenetriamine (DETA), and can also be selected from a list that includes triethylenetetramine, tetraethylenepentamine, pentaethylenehexamine, 2-[(2aminoethyl)amino]ethanol, Tris-(2-aminoethyl)amine, N-methyl ethylenediamine and 1,2 diamino 2 methylpropane.

U.S. Pat. No. 5,411,148 describes a process for the improved separation of mono- or multi-metallic sulphide minerals from iron sulphides. The process comprises a conditioning stage before flotation with at least one water-soluble sulphur-containing inorganic compound as a prerequisite step before further conditioning with a nitrogen-containing organic chelating agent which is described in U.S. Pat. No. 5,074,993. The water-soluble sulphur-containing inorganic compound is preferably sodium sulphite ($Na_2SO_3$), and can also be selected from the group consisting of sulphides, dithionates, tetrathionates, and sulphur dioxide, in an amount varying from 50 to 600 g/mt of dry solids processed. The nitrogen-containing organic chelating agent is preferably a polyethylenepolyamine such as diethylenetriamine (DETA) used at an adequate dosage for a particular flotation feed. The pyrrhotite is depressed as a result of the combined effects of the sulphur-containing compound and the nitrogen-containing organic compound, added in a particular order.

The aforementioned processes are very effective at increasing Ni and Cu concentrate grade and recovery with selective pyrrhotite depression. However, the use of DETA can complicate the operation of the wastewater treatment regarding the total (soluble and insoluble) Cu and Ni discharged in the effluent. DETA is a strong chemical chelating agent that forms stable complexes with heavy metal ions, such as Cu and Ni. These complexes cannot be precipitated out by raising the pH above 11, as is typically done in the wastewater treatment plants. Instead, a polyamine precipitating agent such as NALMET® 8702 (available from the Nalco Company, Naperville, Ill.) is added to the wastewater to react with the DETA-metal complexes and form a precipitate. However, the precipitates are very fine particles which do not settle in the clarifier, making it difficult to effectively remove the Cu and Ni from the wastewater. In order to avoid a high level of Cu and Ni in the wastewater when using DETA, efforts are being made to identify alternative iron sulphide depressants to reduce or eliminate the use of DETA.

A recent patent from LignoTech (U.S. Pat. No. 8,221,709) describes a method of using hardwood lignosulphonates for separating gangue materials from metallic sulphide ore. The patent specifies three hardwood lignosulphonates obtained from Eucalyptus, Maple, and Birch trees with different sulphur or sulphonate contents and molecular weights, and compared their performances at dosages of ~250-500 g/mt with NaCN additions in the flotation of a ground ore slurry which comprised copper sulphide, zinc sulphide, or lead sulphide with iron sulphides. The lignosulphonates can be added before or after other reagents and pH adjustments. However, the selectivity between Cu/Ni sulphides and pyrrhotite is not improved with the addition of lignosulphonate alone in the industrial process.

In this sense, the state of the art lacks a method for a) improving the selectivity and recovery in the flotation of Cu/Ni sulphide minerals which are associated with iron sulphides, and b) reducing or eliminating the use of problematic polyamine chemicals (such as DETA) to minimize the negative impact on the environment.

SUMMARY OF THE INVENTION

In light of the problems and unmet needs described above, the present invention discloses a method of using the synergy of multiple depressants to improve the depression of iron sulphide without compromising the recovery of the valuable sulphide minerals in the flotation of non-ferrous metal sulphides, while reducing or eliminating the use of environmentally problematic chemicals such as polyamines. The method has significant economic and environmental benefits. Included are examples of the flotation of Cu/Ni sulphide ore with pyrrhotite, either as freshly ground slurry or as a pre-treated and finely ground process intermediate during a flotation process.

The essence of the process involves the use of multiple depressants, taking advantage of the individual depression effect of each chemical, and generating a synergistic effect to improve selectivity and recovery and reduce polyamine usage by at least 50%, or eliminate it whenever possible. The three chemicals used include: 1) A polyamine, such as DETA; 2) A water-soluble sulphur-containing inorganic compound, such as sodium sulphite; and 3) A hardwood lignosulphonate product, preferably a calcium lignosulphonate with a 6 kDa molecular weight, 5% sulphonate, and 2% sugar, and specifically the D-912 product from LignoTech. Used individually, the chemicals either a) do not generate sufficient pyrrhotite depression, or b) decrease the Cu/Ni recovery, or c) cause environmental discharge problems at the wastewater treatment plant due to potentially high levels of heavy metals.

The three chemicals can be added separately at the same time, or added sequentially with no preferred order, or premixed into a single solution with a preferred ratio. Similarly, two components can be premixed into a single solution with a preferred ratio and added to the third one separately with varying amounts. The depressants can be added before or after other flotation reagents.

Aspects of the present invention promote the improvement of the selective recovery of the non-ferrous pay metals which are associated with iron sulphides.

Aspects of the present invention promote synergy between the depressants and the collector allowing for a reduction of the polyamine (i.e. DETA) dosage by at least 50% over that typically used with the DETA/$Na_2SO_3$ combination, without compromising the selectivity and recoveries during flotation.

Aspects of the current invention help avoid discharges of heavy metals and DETA at the wastewater treatment plant exceeding the mandated limits that can occur due to the formation of DETA-metal complexes.

Additional advantages and novel features of these aspects of the invention will be set forth in part in the description that follows, and in part will become more apparent to those skilled in the art upon examination of the following or upon learning by practicing the invention.

BRIEF DESCRIPTION OF THE DRAWINGS

Various exemplary aspects of the systems and methods will be described in detail, with reference to the following figures but not limited to, wherein.

DETAILED DESCRIPTION

Figure 1:
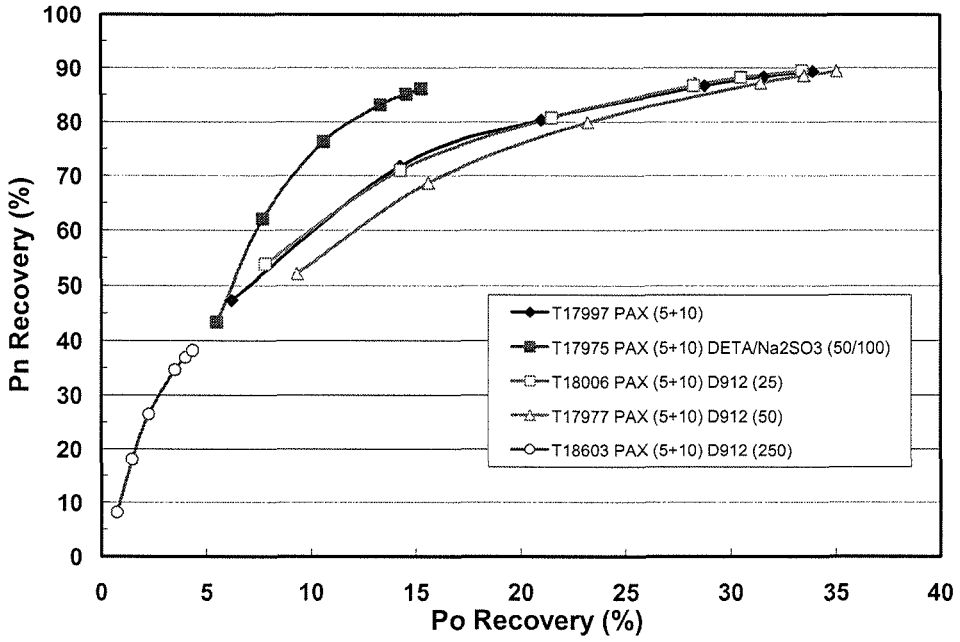
FIG. 1 is a plot graph illustrating ineffective pyrrhotite depression with D-912 alone in rougher flotation.

The following detailed description does not intend, in any way, to limit the scope, applicability or configuration of the invention. More specifically, the following description provides the necessary understanding for implementing the exemplary features of the invention. When using the teachings provided herein, those skilled in the art will recognize suitable alternatives that can be used, without extrapolating the scope of the present invention.

The present invention describes a method of using the synergistic effect of multiple depressants to selectively float sulphide minerals which contain at least one or more non-ferrous pay metals and which are associated with iron sulphides consisting mainly of pyrrhotite to obtain an excellent grade and recovery of the non-ferrous pay metal values. By taking advantage of the synergistic effect obtained by using multiple depressants, the dosage of one of the key chemicals (i.e. DETA) can be significantly reduced, thereby alleviating a potential negative impact to the environment. The method comprising:

i) Treating a sulphide ore, either freshly ground slurry or a pre-treated and finely ground process intermediate, which contains at least one or more non-ferrous pay metal sulphide minerals (Cu/Ni) with iron sulphides (pyrrhotite), in an aqueous alkaline slurry in the presence of a collector, a frother, a pH modifier, and a carrier gas distributed through the slurry, and the multiple depressants.

The slurry to be treated contains up to ~80% iron sulphide. The non-ferrous pay metals sulphides can be pentlandite and millerite, chalcopyrite and chalcocite and bornite, galena, and sphalerite which are the valuable minerals for Ni, Cu, Pb and Zn respectively. The iron sulphides can be pyrrhotite, pyrite and marcasite.

The collector can be selected from at least one of xanthate, dithiophosphate, thionocarbamate, dithiocarbamate, dithiophosphinate, xanthogen formates, xanthic esters or a mixture thereof. Potassium amyl xanthate is used as an example. The dosage of the collector is adjusted according to the dosage of depressants for good recovery of the pay metals.

The frother tested is a polyglycolether (F160-13, Flottec), but can also be selected from at least one of natural oils, alkoxy paraffins, aliphatic alcohol, polyglycol ethers, polypropylene glycols. The frother is not a dominant factor in the current invention.

The pH modifier tested is lime at pH 9.5, but can also be soda ash or sodium hydroxide. The pH can range from 8 to 12.

The carrier gas used is air. It can also be nitrogen, nitrogen-enriched air or oxygen-enriched air, or carbon dioxide (enriched air).

Conditioning steps are required after making additions of the collector or depressants.

The flotation machine can be a standard Denver flotation machine with either a 2.2 L cell and a motor speed of 1200 rpm, or a 1.1 L cell and a motor speed of 900 rpm.

ii) The multiple depressants contain at least one organic polymer (calcium lignosulphonates from hardwood), at least one sulphur-containing compound, and at least one nitrogen-containing organic compound (polyamine), the latter being present at lesser amounts in the mixture than would be needed if it was being used alone or in combination with one sulphur-containing compound.

The said "organic polymer" is at least one water-soluble organic negatively charged polymer selected from the group consisting of one or more of lignosulphonate, dextrin, guar gum, tapioca, starch, or cellulose. The preferable one is a calcium lignosulphonate from hardwood with 6 kDa molecular weight, 5% sulphonate and 2% sugar. One such product is "D-912" from LignoTech, as identified in the LignoTech patent.

The said "sulphur-containing compound" is at least one water-soluble inorganic sulphur-containing compound selected from the group consisting of one or more sulphides, sulphites, hydrosulphites, meta-bisulphates, dithionates, tetrathionates, and sulphur dioxide. The preferable one is sodium sulphite ($Na_2SO_3$).

The said "nitrogen-containing organic compound" is at least one nitrogen-containing organic compound having a configuration selected from the group consisting one of or more polyethylene-polyamines with OCNCCCNCNC and NCCN structures, including diethylenetriamine, triethylenetetramine, tetraethylenepentamine, pentaethylenehexamine, hydroxyethyl-DETA, diethanolamine, and aminoethylethanolamine. The preferable one is diethylenetriamine (DETA).

iii) The addition of multiple depressants has the following options with some conditioning time allowed:

They can be added separately at the same time; or

They can be added sequentially without any preferred order, with or without conditioning between each other; or They can be premixed into a single solution with a determined preferential ratio; or Two of the components can be premixed into a single solution with a determined preferred ratio, with the third component added separately in varying amounts as needed.

The depressants can be added before or after the collector, with some conditioning.

iv) The dosages of the depressants for the synergistic effect and reduced polyamine usage will depend on the ore type, grade and its mineralogical composition and should therefore be determined experimentally. For the tested ore samples, D-912 dosages ranged from 50 to 150 g/t, $Na_2SO_3 \geq 100$ g/t, and DETA from 0 to 50 g/t. The quoted dosages refer back to the ground ore, even for intermediate streams. The DETA dosage is kept as low as possible without compromising the overall selectivity and recovery, to avoid the high levels of heavy metals in the wastewater.

v) The collector dosage will be adjusted accordingly for the optimal metallurgy as there is competition between collectors and depressants.

In the preferred embodiments, the invention refers to a method of using the synergistic effect of multiple depressants to selectively float at least one or more sulphide minerals which contain at least one or more non-ferrous pay metals and which is/are associated with iron sulphide in a sulphide ore, the process comprising:

i) Treating a sulphide ore, either freshly ground slurry or a pre-treated and finely ground process intermediate, which contains at least one of said valuable sulphide minerals associated with at least one iron sulphide mineral, in an aqueous alkaline slurry in the presence of a collector, a frother, a pH modifier, a carrier gas distributed through said slurry, and multiple depressants selected to include at least one organic polymer, at least one sulphur-containing compound, and/or at least one nitrogen-containing organic compound; and ii) Carrying out froth flotation to depress the iron sulphides, while allowing the flotation of the valuable non-ferrous sulphides.

In another preferred embodiment, the invention refers to a method of using the synergistic effect of multiple depressants to selectively float at least Ni/Cu/Co sulphide minerals which contain at least Ni, Cu, Co, Pt, Pd, Au, and Ag pay metals and which is/are associated with iron sulphide minerals including at least pyrrhotite in a sulphide ore, the process comprising:

i) Treating a Ni/Cu/Co sulphide ore, either freshly ground slurry or a pre-treated and finely ground process intermediate, which contains at least the minerals pentlandite and chalcocite associated with at least pyrrhotite, in an aqueous alkaline slurry in the presence of a collector, a frother, a pH modifier, a carrier gas distributed through said slurry, and multiple depressants including a calcium-lignosulphonate product (preferably a product such as D-912), a sodium sulphite ($Na_2SO_3$) and/or DETA; and ii) Carrying out froth flotation to depress the pyrrhotite, while allowing the flotation of the valuable pentlandite and chalcocite.

Alternatively, the method of adding the three depressants may comprise 1) separately, but all at the same time; and 2) sequentially with individual conditioning.

Additionally, the depressants solution can be added before or after the collector.

The dosages of the depressants for the synergistic effect and reduced polyamine usage were found to depend on the ore type, grade and its mineralogical composition and should therefore be determined experimentally. For the tested ore samples, D-912 dosages ranged from 50 to 150 g/t, $Na_2SO_3 \geq 100$ g/t, and DETA from 0 to 50 g/t. The quoted dosages refer back to the ground ore, even for intermediate streams.

The synergistic pyrrhotite depression obtained when using multiple depressants (i.e. by combining DETA, $Na_2SO_3$ and D-912) is obtained by maximizing the pyrrhotite depression obtained with each depressant at a minimum dosage. More specifically, DETA, $Na_2SO_3$ and D-912 have their own unique functions in iron sulphide depression. Pyrrhotite flotation has three proposed mechanisms; 1) Cu activation to promote collector (xanthate) adsorption; 2) Formation of poly-sulfur to produce some hydrophobic sites on the pyrrhotite surface for the air bubble to attach to; and 3) Formation of dixanthogen for hydrophobic sites. DETA can remove or mask the $Cu^{2+}$ activation sites on the iron sulphides to inhibit collector adsorption on the surface. $Na_2SO_3$ can prevent iron sulphide flotation by removing the adsorbed collector or the poly-sulfur formed on the iron sulphide surface. D-912 is a negatively charged hydrophilic polymer which can adsorb onto the iron sulphide surface through active sites (such as $Fe(OH)^{2+}$, $Ca^{2+}$ or $Cu^{2+}$) to render its surface hydrophilic, thus depressing the iron sulphide.

With any one of the depressants used singly, no effective pyrrhotite depression is obtained without compromising pay metal recovery or causing high levels of heavy metals in the wastewater. By using three different depressants simultaneously, a synergistic effect is created. An advantage can be obtained from each of the three reagents, resulting in maximizing the iron sulphide depression while minimizing decreases in the recovery of the valuable minerals.

EXAMPLES

The following examples are meant to illustrate, and not in any way to limit the scope, applicability, or configuration of the claimed invention.

In the figures, it should be noted that short forms have been used in the axis titles for the minerals. Included are the notations: Pn (pentlandite), Cp (chalcopyrite), and Po (pyrrhotite).

Example 1

Ineffective Pyrrhotite Depression with D-912 Alone

FIG. 1 presents results for the cumulative recovery of pentlandite and pyrrhotite in the rougher flotation of a nickel-copper ore containing about 1.5% Ni (3.7% pentlandite), 1.5% Cu (4.3% chalcopyrite) and 21% Fe (19.7% pyrrhotite) and 72.3% rock (other silicates), which was treated according to the procedure in U.S. Pat. No. 8,221,709 (LignoTech), using the hardwood lignosulphonate product D-912 alone as a pyrrhotite depressant. In this test, 1 kg of the ore was ground in a rod mill to reach P80~106 μm, with the addition of 5 g/t of collector (PAX—potassium amyl xanthate) and 400 g/t of lime. The incremental rougher tests were performed at pH 9.5 with lime as the modifier. There were 2 minutes of conditioning after the addition of depressants and collector respectively and 15 ppm frother (F160-13) is in the process water. A 2.2 L Denver flotation cell was used with a 1200 rpm rotation shaft and 3 L/min of air was applied in flotation. The concentrates were collected after 0.5, 1, 2, 5, 8 and 12 minutes. The additions of the chemicals added into the rougher are summarized in Table 1.

TABLE 1

| Sample #. | $Na_2SO_3$ (g/t) | DETA (g/t) | D912 (g/t) | PAX (g/t) | Notes |
|---|---|---|---|---|---|
| 1-T17997 | 0 | 0 | 0 | 5 + 10 | Baseline without depressants |
| 2-T17975 | 100 | 50 | 0 | 5 + 10 | Baseline with effective Po depression |
| 3-T18006 | 0 | 0 | 25 | 5 + 10 | D912 alone |
| 4-T17977 | 0 | 0 | 50 | 5 + 10 | D912 alone |
| 5-T18603 | 0 | 0 | 250 | 5 + 10 | D912 alone |

The test with the collector (PAX) alone showed no pyrrhotite depression. The test with DETA/$Na_2SO_3$ represented an acceptable pyrrhotite depression and pay metal recovery.

Using the hardwood lignosulphonate product D-912 as a pyrrhotite depressant at a dosage of 25 to 50 g/t did not improve the pyrrhotite depression in comparison to the use of the combination of DETA and $Na_2SO_3$ (i.e. the "Baseline" chemicals). At a high D-912 dosage of 250 g/t, pentlandite was significantly depressed without improving the selectivity of pentlandite/pyrrhotite in comparison to the combination of DETA and $Na_2SO_3$.

Example 2

Effective Pyrrhotite Depression with D-912 and $Na_2SO_3$ for One Ore Feed

Figure 2:
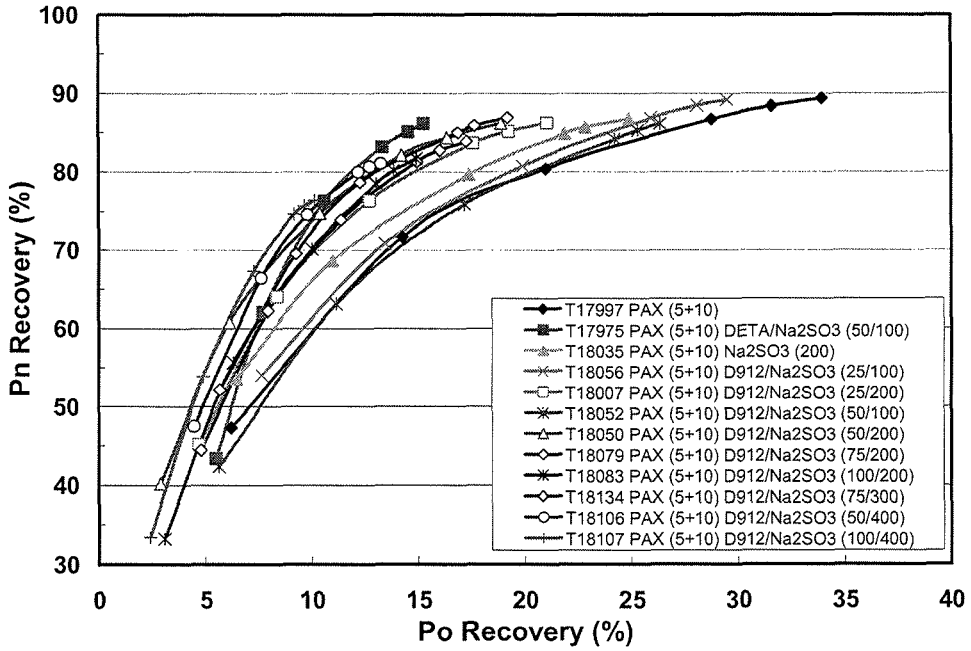
FIG. 2 is a plot graph illustrating effective pyrrhotite depression with D-912 and $Na_2SO_3$ in rougher flotation.

FIG. 2 presents results for the cumulative recovery of pentlandite and pyrrhotite in the rougher flotation of the same nickel-copper ore as used in Example 1, in which $Na_2SO_3$ was added with D-912 into the rougher. The ore was ground in the same manner as in Example 1, including the 5 g/t addition of the collector (PAX) and the 400 g/t addition of lime. Pyrrhotite depression was observed when the $Na_2SO_3$ dosage was ≥200 g/t. The additions of the chemicals into the rougher flotation are summarized in Table 2.

TABLE 2

| Sample # | $Na_2SO_3$ (g/t) | DETA (g/t) | D912 (g/t) | PAX (g/t) |
|---|---|---|---|---|
| 6-T18035 | 200 | 0 | 0 | 5 + 10 |
| 7-T18056 | 100 | 0 | 25 | 5 + 10 |
| 8-T18007 | 200 | 0 | 25 | 5 + 10 |
| 9-T18052 | 100 | 0 | 50 | 5 + 10 |
| 10-T18050 | 200 | 0 | 50 | 5 + 10 |
| 11-T18079 | 200 | 0 | 75 | 5 + 10 |
| 12-T18083 | 200 | 0 | 100 | 5 + 10 |
| 13-T18134 | 300 | 0 | 75 | 5 + 10 |
| 14-T18106 | 400 | 0 | 50 | 5 + 10 |
| 15-T18107 | 400 | 0 | 100 | 5 + 10 |

The test with the collector (PAX) alone showed no pyrrhotite depression. The test with DETA/$Na_2SO_3$ represented an acceptable pyrrhotite depression and pay metal recovery.

It was demonstrated that using a dosage of 200 g/t $Na_2SO_3$ by itself had some effect on pyrrhotite depression, but the results were not as good as those obtained using the baseline chemicals DETA and $Na_2SO_3$. In the tests with D-912 and $Na_2SO_3$, some indications of pyrrhotite depression were observed when the $Na_2SO_3$ dosage was >100 g/t. When the $Na_2SO_3$ dosage was ≥200 g/t and the D-912 dosage was ≥50 g/t, similar pentlandite/pyrrhotite selectivity curves were obtained with D912/$Na_2SO_3$ as the baseline DETA/$Na_2SO_3$. Increasing the dosage of D-912 from 25 to 100 g/t and the dosage of $Na_2SO_3$ from 200 to 400 g/t did not significantly change the shape of the pentlandite/pyrrhotite selectivity curves (i.e. the pentlandite recovery dropped with a decrease in the pyrrhotite recovery).

For this feed, there was no need to add DETA, which is preferable for environmental concern.

Example 3

Lower Recoveries with D-912 and $Na_2SO_3$ for an Intermediate Stream

Figure 3A:
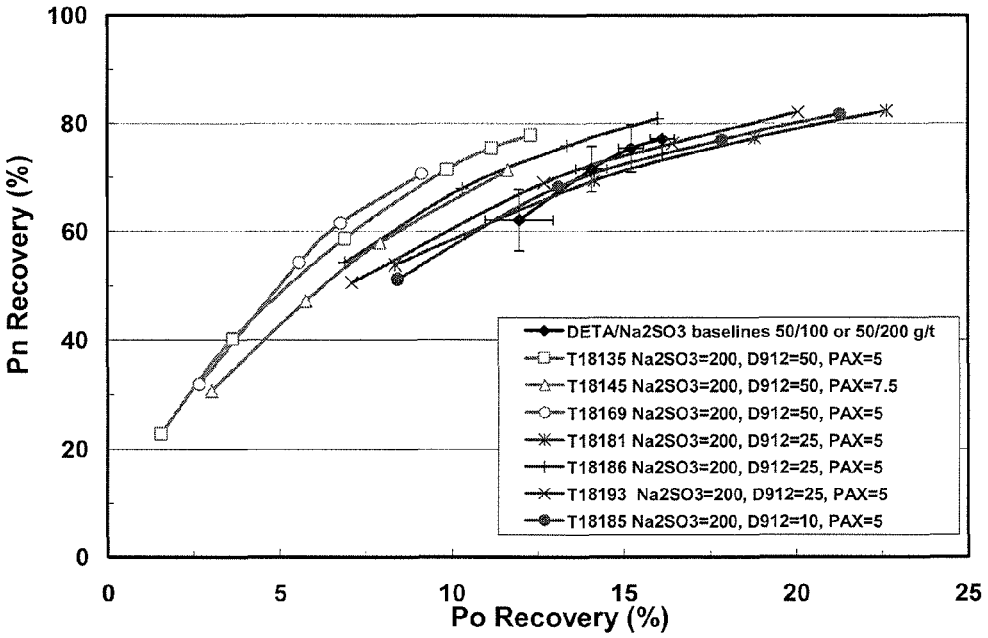
FIGS. 3A and 3B are plot graphs illustrating lower recoveries with D-912 and $Na_2SO_3$ for an intermediate stream.
Figure 3B:
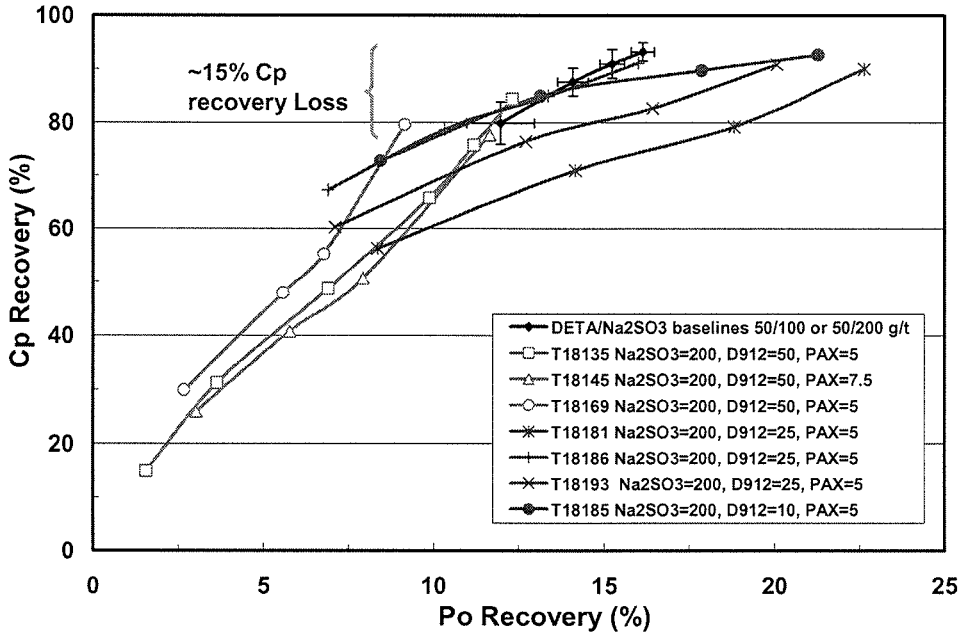

FIGS. 3A and 3B present results for the cumulative pentlandite/pyrrhotite and chalcopyrite/pyrrhotite selectivities respectively in the cleaner flotation of an intermediate stream containing 7.6% Cu (21.9% chalcopyrite), 6.4% Ni (17.3% pentlandite), 37% Fe (39.8% pyrrhotite), and 21% Rock, in which $Na_2SO_3$ was added with D-912 into the cleaner. This study involved rougher and cleaner flotation tests and the depressants were added into the cleaner stage. A total of 10 g/t of collector (PAX) was added into the rougher flotation and the rougher concentrate was collected for 6 min. The rougher concentrates were treated in the cleaner stage at pH 9.5 with lime as the modifier. There were 2 minutes of conditioning after the addition of depressants and collector respectively and 15 ppm frother (F160-13) is in the process water. A 1.1 L Denver flotation cell was used with a 900 rpm rotation shaft and 1 L/min of air was applied in cleaner flotation. The cleaner concentrates were collected after 1.5, 3, 5 and 16 minutes. The additions of the chemicals into the cleaner flotation are summarized in Table 3.

TABLE 3

| Sample #. | $Na_2SO_3$ (g/t) | DETA (g/t) | D912 (g/t) | PAX (g/t) |
|---|---|---|---|---|
| 16-baseline | 100 or 200 | 50 | 0 | 5 or 7.5 |
| 17-T18135 | 200 | 0 | 50 | 5 |
| 18-T18145 | 200 | 0 | 50 | 7.5 |
| 19-T18169 | 200 | 0 | 50 | 5 |
| 20-T18181 | 200 | 0 | 25 | 5 |
| 21-T18186 | 200 | 0 | 25 | 5 |
| 22-T18193 | 200 | 0 | 25 | 5 |
| 23-T18185 | 200 | 0 | 10 | 5 |

It was observed that the selectivity was improved and even better than the DETA/$Na_2SO_3$ baseline when the D-912 dosage was ≥50 g/t with 200 g/t of $Na_2SO_3$. However, the recovery of chalcopyrite decreased by ~15%. If the dosage of D-912 is further decreased (≤25 g/t) or the dosage of PAX is increased, the selectivity will be compromised. This is not acceptable for industrial production.

Example 4

Figure 4A:
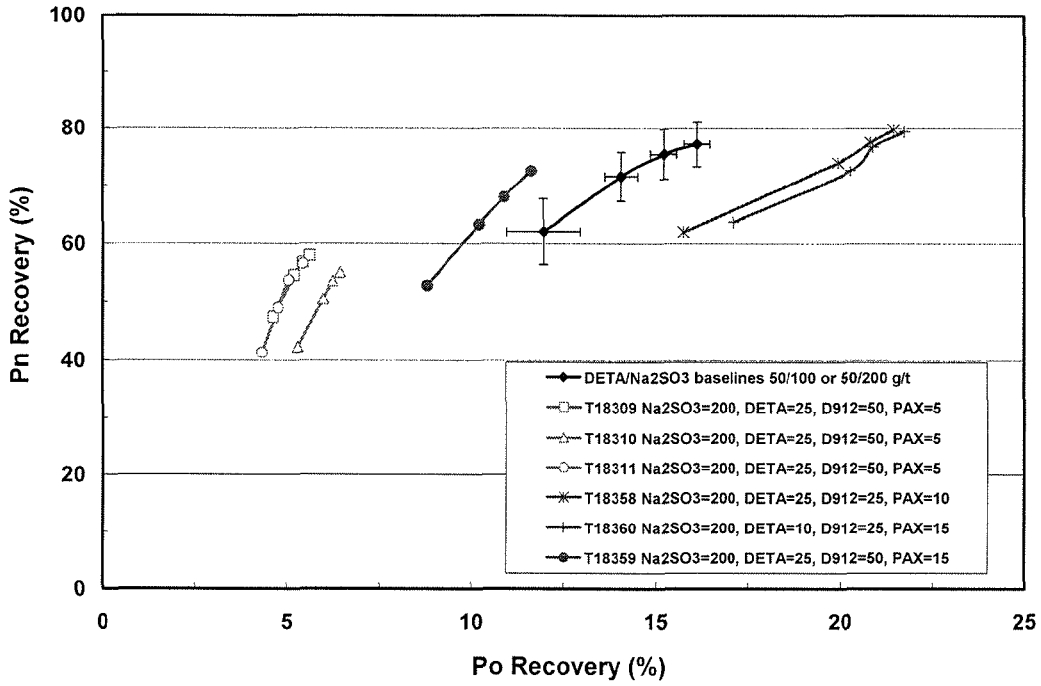
FIGS. 4A and 4B are plot graphs illustrating the synergy of pyrrhotite depression with D-912, $Na_2SO_3$, DETA, and PAX for an intermediate stream—effect of dosages and the order of addition.
Figure 4B:
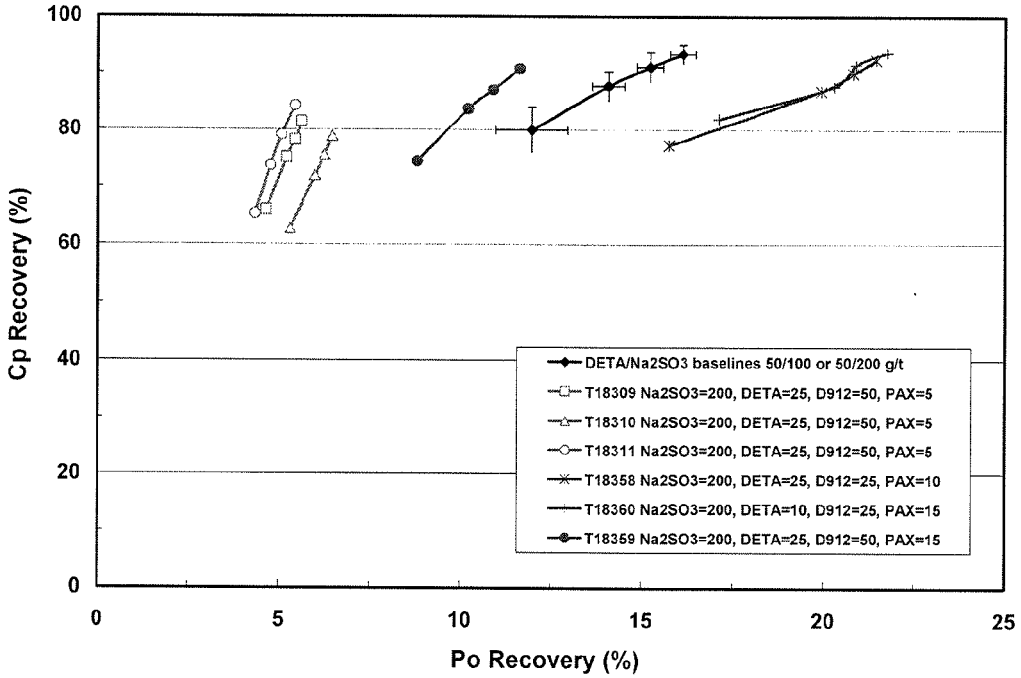

The Synergy of Pyrrhotite Depression with D-912, DETA, $Na_2SO_3$, and PAX for an Intermediate Stream FIGS. 4A and 4B present results for the cumulative pentlandite/pyrrhotite and chalcopyrite/pyrrhotite selectivities respectively from the cleaner flotation of the same intermediate stream as used in Example 3. In this example, DETA was added with $Na_2SO_3$ and D-912 into the cleaner, but at reduced dosage compared to when DETA and $Na_2SO_3$ were used together as part of the "Baseline" conditions. This study involved rougher and cleaner flotation tests as described in Example 3. The additions of the chemicals into the cleaner flotation are summarized in Table 4.

TABLE 4

| Sample #. | $Na_2SO_3$ (g/t) | DETA (g/t) | D912 (g/t) | PAX (g/t) | Notes |
|---|---|---|---|---|---|
| 24-T18309 | 200 | 25 | 50 | 5 | First $Na_2SO_3$ & DETA added together; PAX second; D912 third. Conditioning in between. |
| 25-T18310 | 200 | 25 | 50 | 5 | First $Na_2SO_3$ & DETA added together; D912 second; PAX third. Conditioning in between. |
| 26-T18311 | 200 | 25 | 50 | 5 | First $Na_2SO_3$, DETA and D912 added together; PAX second. Conditioning in between. |
| 27-T18358 | 200 | 25 | 25 | 10 | |
| 28-T18360 | 200 | 10 | 25 | 10 | |
| 29-T18359 | 200 | 25 | 50 | 15 | |

In tests in which the dosages of each chemical were fixed (T18309, T18310, T18311), the order of adding the chemicals was varied. No significant differences in the results were seen.

In tests in which the dosages of the depressants and collector were varied, either the selectivity was very good but the recoveries of pentlandite and chalcopyrite were far below target (T18309, T18310, T18311), or the recoveries of pentlandite and chalcopyrite were acceptable but the selectivity was significantly reduced (T18358, T18360).

The selectivity and recovery approached the "Baseline" results only when a balance between the collector and depressants was reached (T18359). At the proper dosages of D-912, DETA, and $Na_2SO_3$ and the collector (PAX), good selectivity and recoveries are obtained.

Example 5

Figure 5:
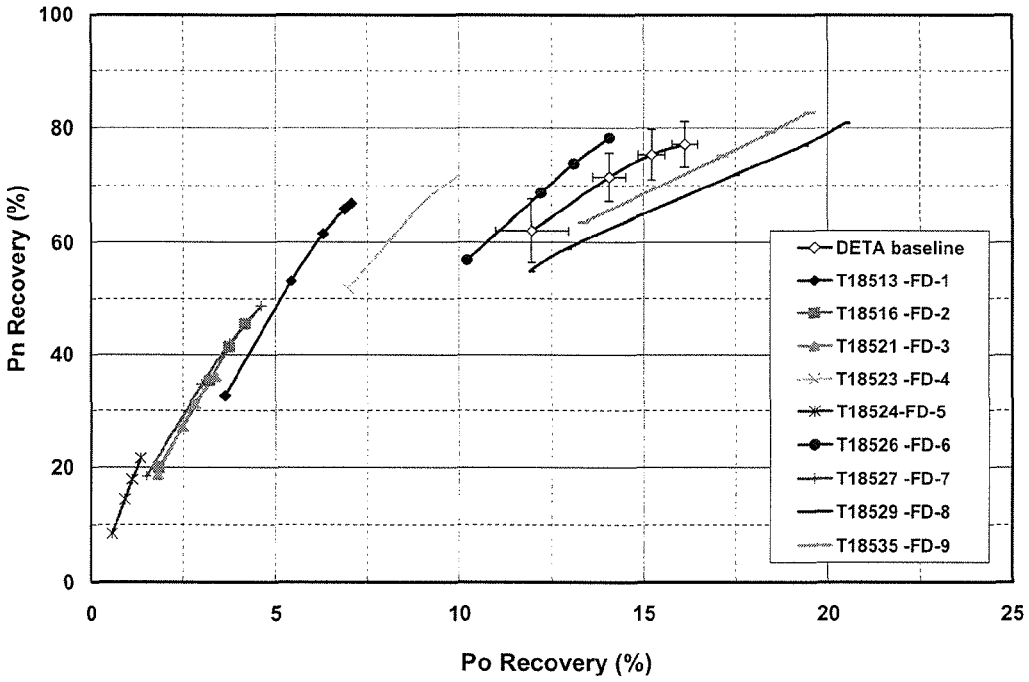
FIG. 5 is a plot graph illustrating the synergy of pyrrhotite depression with D-912, $Na_2SO_3$, DETA, and PAX for an intermediate stream—optimal dosages from factorial design tests.

Factorial Design Tests to Find the Optimal Dosages of D-912, DETA, and $Na_2SO_3$, and PAX for the Synergy of Pyrrhotite Depression for an Intermediate Stream FIG. 5 presents results of a $2^3$ factorial design study of the interaction between D-912, DETA, and the collector (PAX) while keeping the dosage of $Na_2SO_3$ fixed. The results from Example 4 indicated that the combination of the three chemicals as depressants generated synergy, which allowed the DETA dosage to be reduced while maintaining good selectivity and pay metal recovery. At the same time, the dosage of the collector was found to play a very important role. In order to further confirm the synergy and determine the optimum range of dosages for each chemical, a three factor—two level ($2^3$) factorial design study on the dosages of PAX, DETA and D-912 was carried out, with the chemicals added to the cleaner stage. The feed was the same as that described in Example 3. The rougher-cleaner flotation procedure was the same as described in Example 3. In all these tests, $Na_2SO_3$ was added at a fixed dosage of 200 g/t. The dosages of DETA, D-912, and PAX and the test conditions are specified in Table 5.

TABLE 5

| | Low (−1) | Standard (0) | High (+1) |
|---|---|---|---|
| DETA (g/t) | 15 | 25 | 35 |
| PAX (g/t) | 10 | 12.5 | 15 |
| D912 (g/t) | 50 | 100 | 150 |

TEST CONDITIONS

| Sample Order | Standard Order | DETA | PAX | D912 |
|---|---|---|---|---|
| 30-FD 1 | 0 | 0 | 0 | 0 |
| 31-FD 2 | 8 | 1 | 1 | 1 |
| 32-FD 3 | 5 | −1 | −1 | 1 |
| 33-FD 4 | 2 | 1 | −1 | −1 |
| 34-FD 5 | 6 | 1 | −1 | 1 |
| 35-FD 6 | 1 | −1 | −1 | −1 |
| 36-FD 7 | 7 | −1 | 1 | 1 |
| 37-FD 8 | 3 | −1 | 1 | −1 |
| 38-FD 9 | 4 | 1 | 1 | −1 |

In the test design, the criteria for selecting the dosages included: a) The DETA dosage should be less than the level that was used in the DETA/$Na_2SO_3$ combination (i.e. usually 50 g/t); b) As previous results showed that D-912 dosages <50 g/t did not work, and the upper limit was not known, the dosages were extended to higher levels; and c) Since the results in Example 5 showed that the recoveries of pentlandite and chalcopyrite were adequate at PAX dosages of 10 to 15 g/t, there was no need to go to much higher dosages than normal (i.e. 5 g/t).

In one group with high dosages of D-912 (FD2, FD3, FD5 and FD7), a high concentrate grade with a very low pentlandite recovery (20~50%) was obtained, indicating that a D-912 level of 150 g/t was too high. In another group with high dosages of PAX and low dosages of D-912 (FD8 and FD9), the pentlandite/pyrrhotite selectivity was reduced, resulting in a concentrate grade below the target. Using the dosages at the middle points of the ranges (FD1) produced results between these limits. It can be seen that at 10 g/t PAX, 50 g/t D-912, and 15 g/t DETA (FD6), good pentlandite/pyrrhotite selectivity was obtained with results approaching those of the DETA/$Na_2O_3$ baseline. Chalcopyrite recovery at these dosages was also very good (~90%).

Example 6

Figure 6A:
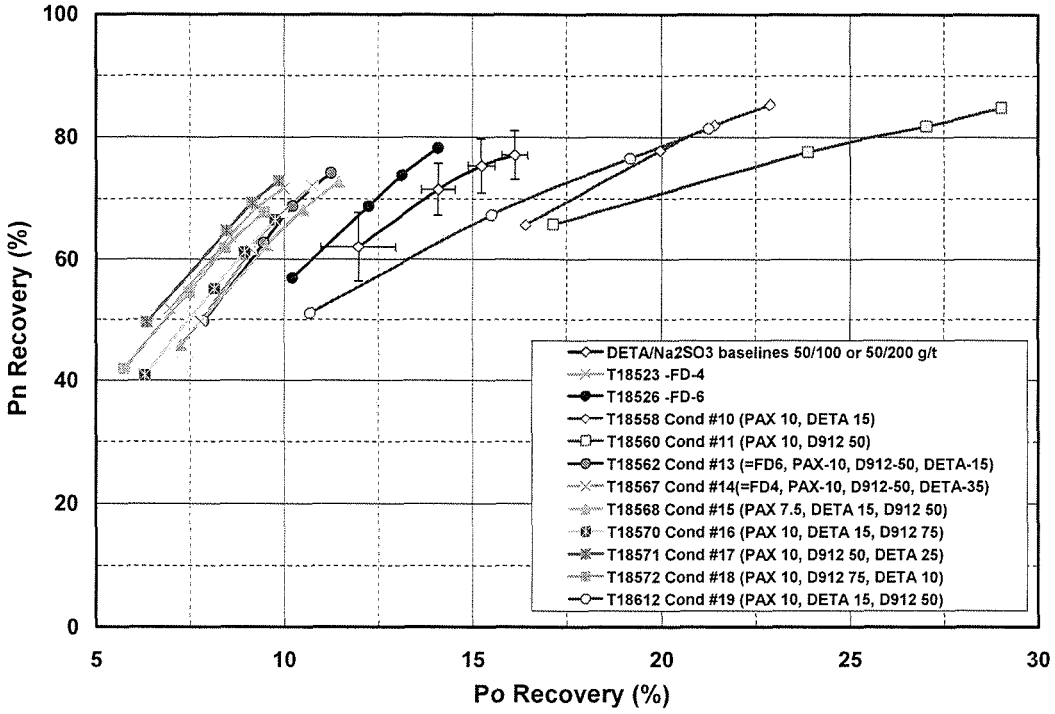
FIGS. 6A and 6B are plot graphs illustrating the synergy of pyrrhotite depression with D-912, $Na_2SO_3$, and DETA for an intermediate stream—synergy studies from optimization and duplicate tests.
Figure 6B:
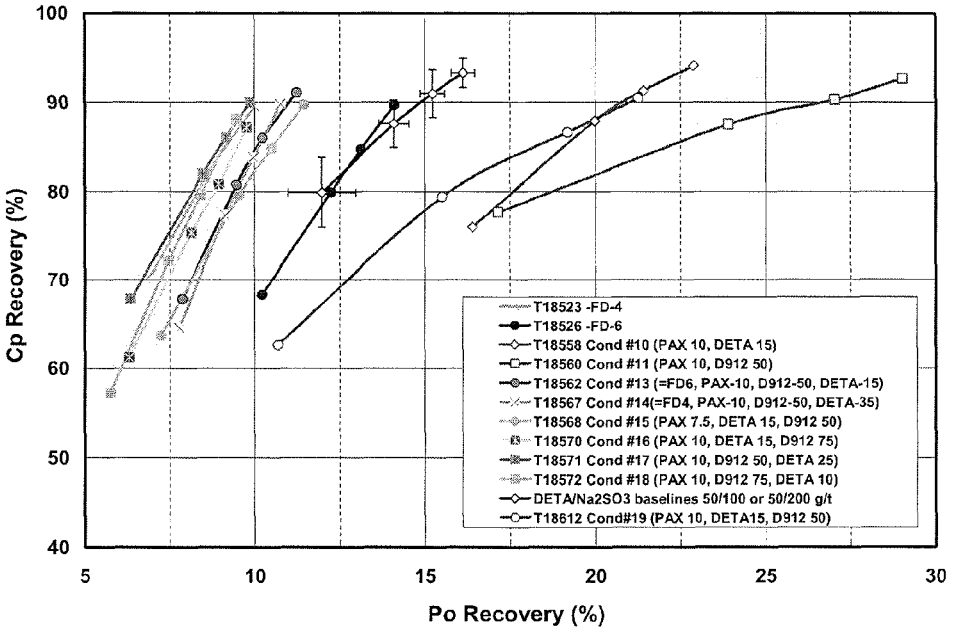

Optimization and Duplication Tests Using D-912, DETA, and $Na_2SO_3$ for the Synergy of Pyrrhotite Depression for an Intermediate Stream FIG. 6 presents results of optimization tests and baseline tests carried out to validate the repeatable synergy that was demonstrated in Example 5 when D-912, DETA, and $Na_2SO_3$ were used together and to optimize the dosages of the chemicals. The rougher-cleaner flotation procedure was the same as described in Example 3. The intermediate stream was the same as that described in Example 3. The dosages of the chemicals added to the cleaner are specified in Table 6. Starting from the conditions which gave good results (FD6: with 15 g/t DETA, 50 g/t D-912, and 10 g/t PAX), when either D-912 (T18558) or DETA (T18560) or $Na_2SO_3$ (T18612) was excluded, the pentlandite/pyrrhotite selectivity was not as good as when all chemicals were used together.

TABLE 8

| Sample # | $Na_2SO_3$ (g/t) | DETA (g/t) | D912 (g/t) | PAX (g/t) | Note |
|---|---|---|---|---|---|
| 57-T20013 | 0 | 0 | 0 | 15 | To the rougher flotation stage |
| 58-T20016 | 150 | 75 | 0 | 15 | To the rougher flotation stage |
| 59-T20027 | 200 | 0 | 100 | 15 | To the rougher flotation stage |
| 60-T20030 | 200 | 30 | 75 | 15 | To the rougher flotation stage |
| 61-T20047 | 100 | 25 | 50 | 15 | To the rougher flotation stage; |
| | 50 | 12.5 | 25 | 0 | To the cleaner flotation stage |
| 62-T20048 | 100 | 25 | 50 | 30 | To the rougher flotation stage; |
| | 50 | 12.5 | 25 | 5 | To the cleaner flotation stage |
| 63-T20065 | 200 | 30 | 75 | 20 | To the rougher flotation stage; |
| | 100 | 0 | 50 | 0 | To the cleaner flotation stage |
| 64-T20066 | 260 | 30 | 100 | 20 | To the rougher flotation stage |

The other repeated and optimized results were all in the same pentlandite/pyrrhotite selectivity range, indicating a stable performance. It can be seen that: a) Increasing the D-912 dosage to 75 g/t decreased pentlandite and chalcopyrite recoveries by a few percentage points; b) Changing the DETA dosages from 15 to 25 and then to 35 g/t did not affect the recoveries and selectivity, so that the lower DETA dosage (15 g/t) was preferred; and c) Decreasing the PAX dosage slightly (i.e. from 10 to 7.5 g/t) did not have a significant impact on the results.

Example 7

The Effect of the Order and Method of Adding D-912, DETA, and $Na_2SO_3$

Figure 7:
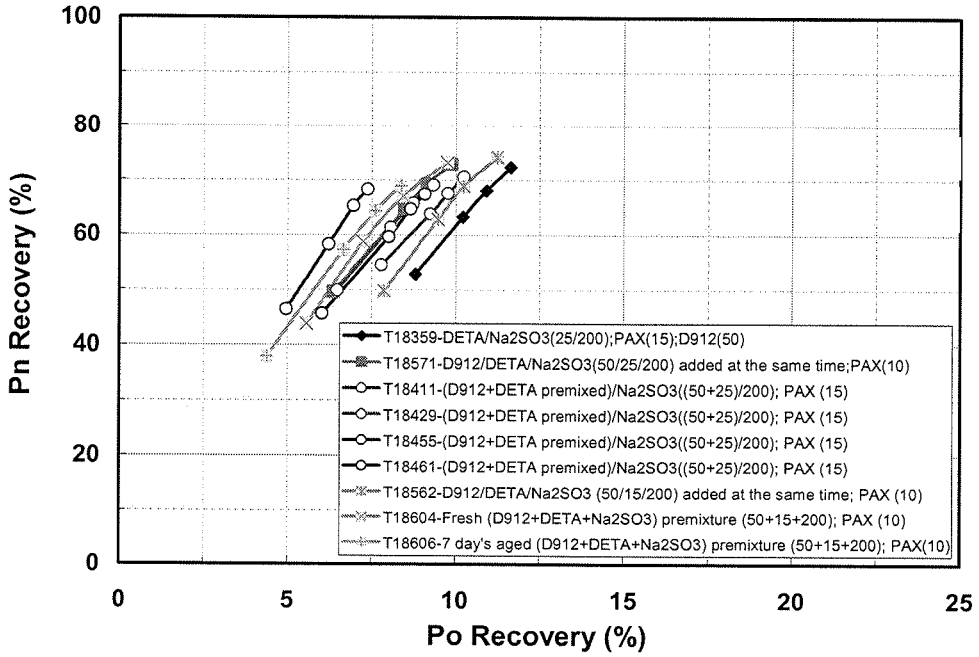
FIG. 7 is a plot graph illustrating pyrrhotite depression with D-912, $Na_2SO_3$, and DETA—effect of the order/method of adding reagents.

FIG. 7 presents results on the evaluation of the order and method of adding the chemicals. The intermediate stream was the same as that described in Example 3. The rougher-cleaner flotation procedure was the same as in Example 3, with the following conditions: 1) Adding the three chemicals (D-912, DETA and $Na_2SO_3$) at the same time with conditioning; 2) Adding $Na_2SO_3$, DETA, and D-912 sequentially with a conditioning time for each addition; 3) Premixing DETA and D-912 into one solution and adding this as a single reagent with $Na_2SO_3$ into the pulp with conditioning; and 4) Premixing DETA, D-912 and $Na_2SO_3$ into one solution and adding this as a single reagent into the pulp with conditioning.

The additions of the chemicals and the conditions of the addition method to the cleaner are summarized in Table 7.

TABLE 9

| | Dosage used (g/t) | | | Residual Concentration (mg/L) | | |
|---|---|---|---|---|---|---|
| | $Na_2SO_3$ | DETA | D912 | DETA | Cu | Ni |
| Baseline: Concentrate Water | 200 | 50 | 0 | 49.6 | 0.3 | 1.7 |
| Baseline: Tailing Water | | | | 9.1 | 0.5 | 1.6 |
| Test: Concentrate Water | 200 | 15 | 50 | 1.2 | 0.1 | 0.4 |
| Test: Tailing Water | | | | 1.9 | 0.1 | 0.7 |

The differences in the results obtained with the various methods of adding the chemicals were not significant, as all the results showed good selectivity. Adding the three chemicals separately has the advantage of being able to adjust each dosage individually. Using a premixed solution gives a simpler solution for the arrangement of chemical storage tanks and delivery lines, which is good when the conditions have been fully established.

Example 8

Figure 8A:
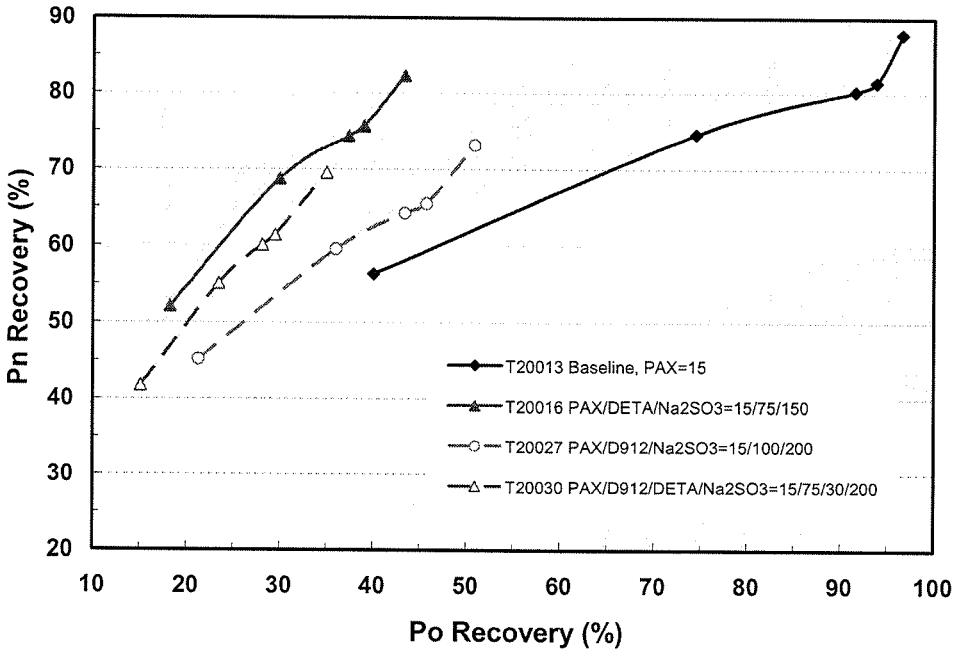
FIGS. 8A and 8B are plot graphs illustrating the synergy of pyrrhotite depression with D-912, $Na_2SO_3$, and DETA in a middling stream.
Figure 8B:
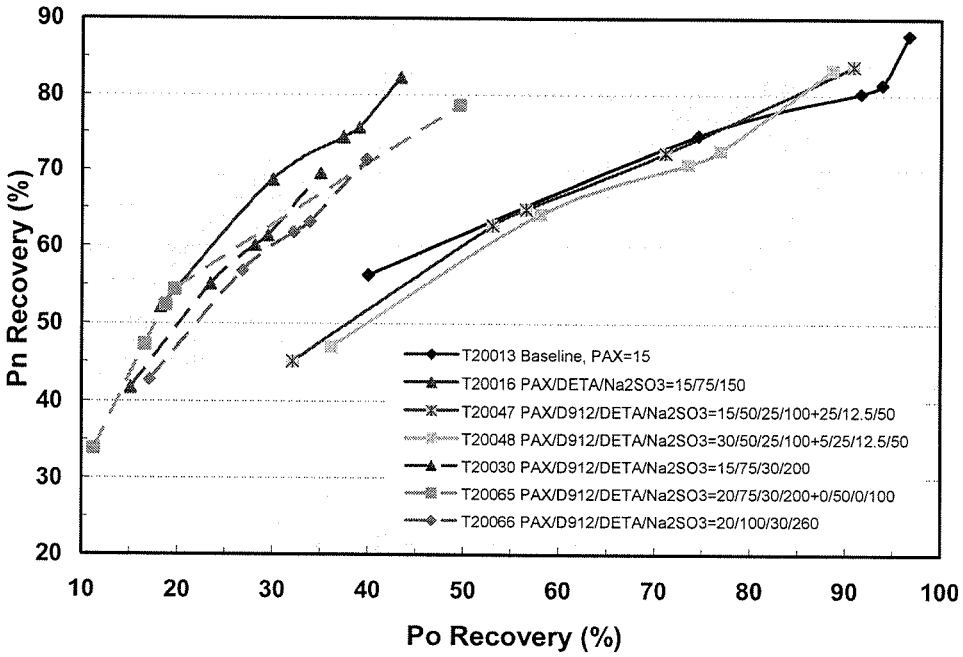

The Synergy of Pyrrhotite Depression with D-912, DETA, and $Na_2SO_3$ for Another Middling Streams FIGS. 8A and 8B present results showing the effect of additions of D-912, $Na_2SO_3$, and DETA on the depression of pyrrhotite in middling streams. Two-stage rougher-cleaner flotation tests were carried out, using a middling feed containing 1.0% Cu (2.7% chalcopyrite), 2.0% Ni (4.3% pentlandite), 44.6% Fe (65.7% pyrrhotite) and 27.3% rock. The additions of the chemicals into the rougher and cleaner stages are summarized in Table 8.

TABLE 6

| Sample # | $Na_2SO_3$ (g/t) | DETA (g/t) | D912 (g/t) | PAX (g/t) | Note |
|---|---|---|---|---|---|
| 39-T18558 | 200 | 15 | ~ | 10 | Without DETA |
| 40-T18560 | 200 | ~ | 50 | 10 | Without D912 |
| 41-T18562 | 200 | 15 | 50 | 10 | repeat of FD 6 |
| 42-T18567 | 200 | 35 | 50 | 10 | repeat of FD 4 |
| 43-T18568 | 200 | 15 | 50 | 7.5 | lower PAX |
| 44-T18570 | 200 | 15 | 75 | 10 | higher D912 |
| 45-T18571 | 200 | 25 | 50 | 10 | higher DETA |
| 46-T18572 | 200 | 10 | 75 | 10 | lower DETA, higher D912 |
| 47-T18612 | ~ | 15 | 50 | 10 | Without $Na_2SO_3$ |

FIG. 8A presents results obtained by adding the depressants into the rougher stages only. As compared with the case with PAX only (T20013), the addition of D-912 resulted in a significantly reduced pyrrhotite recovery. The effect on pyrrhotite depression of combining D-912 and $Na_2SO_3$ (T20027) was not as good as when D-912, $Na_2SO_3$, and DETA were used together (T20030). The results from the test with the three chemicals were closer to the DETA/$Na_2SO_3$ Baseline (T20016), but with a much lower DETA addition (~40% of DETA).

FIG. 8B presents results obtained by adding the depressants into both the rougher and cleaner stages. When using a combination of the three chemicals (D-912, DETA, and $Na_2SO_3$), adding an adequate amount of D-912 into the rougher stage is most critical. If this dosage is not high enough (i.e. <75 g/t of D-912) in the rougher stage, little pyrrhotite depression occurs. With a high dosage of D-912 in the rougher stage, adding more D-912 to the cleaner stage can further improve the pentlandite/pyrrhotite selectivity. In summary, adequate dosages of D-912, DETA, $Na_2SO_3$, and PAX are required to achieve good pentlandite/pyrrhotite selectivity in the flotation of high pyrrhotite middling streams.

Example 9

Figure 9A:
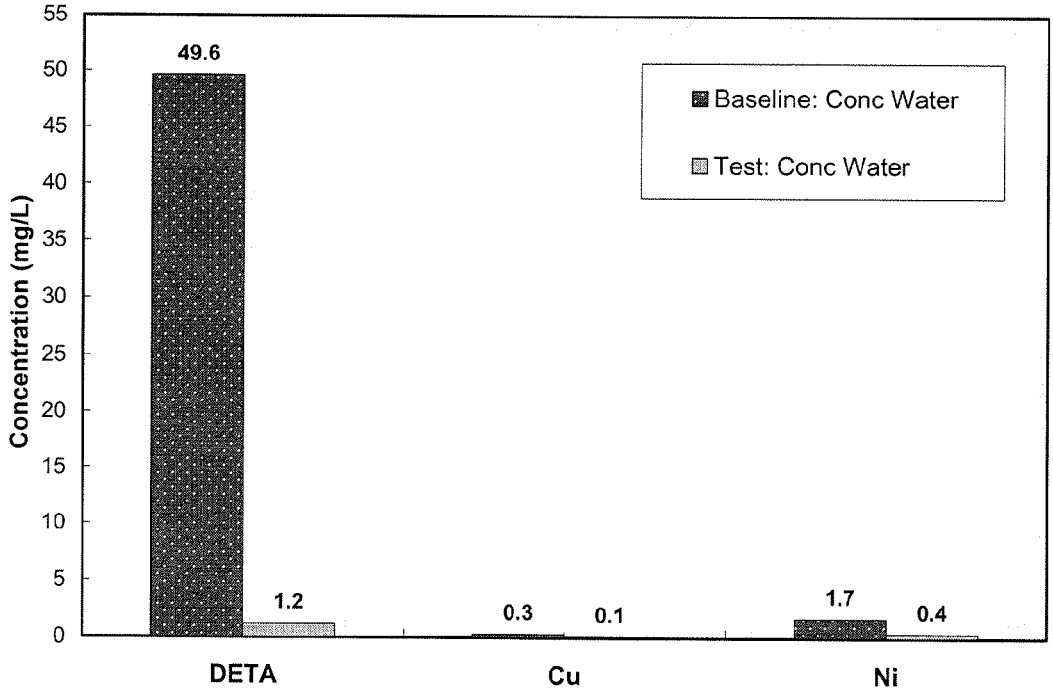
FIG. 9 is a bar graph illustrating pyrrhotite depression with D-912, $Na_2SO_3$, and DETA—decreasing the residual DETA, Cu, and Ni concentrations in concentrate and tailings waters
Figure 9B:
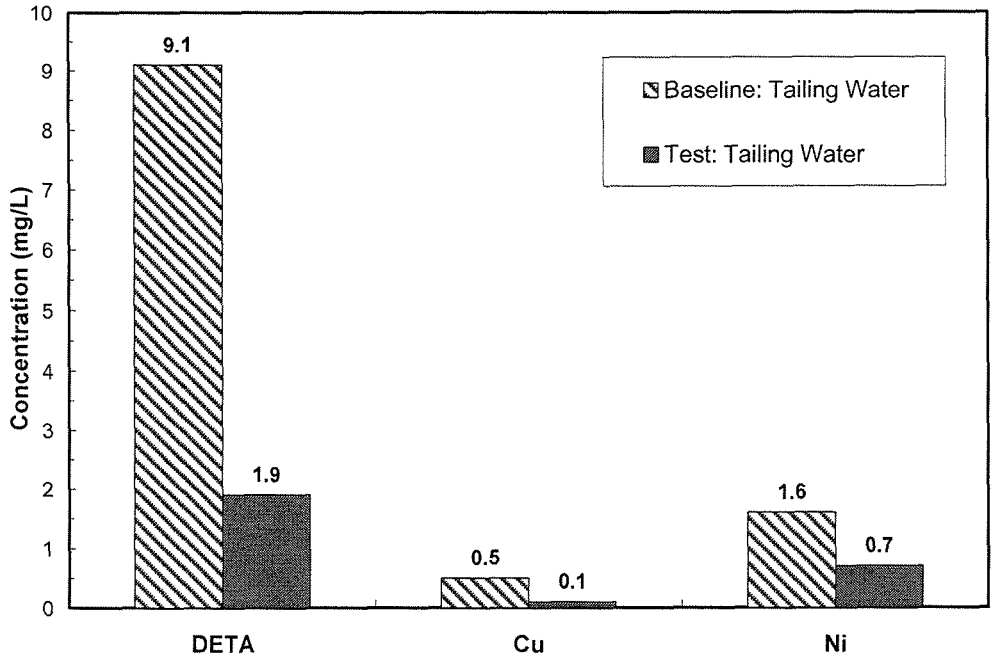

Decreasing the Residual Amounts of DETA, Cu, and Ni in the Process Water by Using the D-912, DETA, and $Na_2SO_3$ Combination FIGS. 9A and 9B illustrate the effect of using the new depressant mixture identified in Examples 5 and 6 on the quality of the concentrate and tailings waters respectively. Two rougher-cleaner flotation tests were carried out using the procedure described in Example 3 on the same nickel-copper ore as used in Example 1. The first test was carried out using the "Baseline" conditions, with 50 g/t DETA, 200 g/t $Na_2SO_3$. The second test was carried out using the new conditions, with 50 g/t D-912, 15 g/t DETA and 200 g/t $Na_2SO_3$. Both sets of conditions were shown previously to result in similar flotation metallurgy. After flotation, the concentrate and tailings waters from each test were collected and analyzed for residual DETA, Cu and Ni. The results of the analyses are summarized in Table 9. The decreased residual levels of DETA, Cu and Ni obtained with the use of the new mixture of D-912, DETA and $Na_2SO_3$ can clearly be seen.

TABLE 7

| Sample # | $Na_2SO_3$ (g/t) | DETA (g/t) | D912 (g/t) | PAX (g/t) | Note |
|---|---|---|---|---|---|
| 48-T18359 | 200 | 25 | 50 | 15 | 1st, DETA/$Na_2SO_3$ added together; 2nd, PAX added; 3rd, D912 added. |
| 49- T18571 | 200 | 25 | 50 | 10 | 1st, D912/DETA/$Na_2SO_3$ added together; 2nd, PAX added. |
| 50- T18411 | 200 | 25 | 50 | 15 | 1st, D912 and DETA premixed into one solution, and added with $Na_2SO_3$ together; 2nd, PAX added. |
| 51-T18429 | 200 | 25 | 50 | 15 | Repeat of #50 |
| 52-T18455 | 200 | 25 | 50 | 15 | Repeat of #50 |
| 53-T18461 | 200 | 25 | 50 | 15 | Repeat of #50 |
| 54-T18562 | 200 | 15 | 50 | 10 | 1st, D912/DETA/$Na_2SO_3$ added together; 2nd, PAX added. |
| 55-T18604 | 200 | 15 | 50 | 10 | 1st, D912, DETA and $Na_2SO_3$ premixed into one solution, and added as freshly prepared; 2nd, PAX added. |
| 56-T18606 | 200 | 15 | 50 | 10 | 1st, 7 days' age of the premixed D912, DETA and $Na_2SO_3$ solution, 2nd, PAX added. |

It is known that the different tailings solids each have specific capacities for stably adsorbing DETA. The results given in Table 9 verified that by using the combination of D-912, DETA and $Na_2SO_3$ with a reduced DETA dosage, the residual amount of DETA in the process water could be significantly decreased. This amount of DETA can be adsorbed on the tailings solids without any negative impact on the wastewater treatment plant.

The invention claimed is:

1. A method for improving the selectivity and recovery of at least one or more valuable non-ferrous sulphide minerals associated with iron sulphides in a froth flotation process on non-ferrous metal sulphides, while reducing the use of environmentally problematic chemicals such as polyamines, by using the synergy of multiple depressants, the method comprising:

i) Treating a sulphide ore, either freshly ground slurry or a pre-treated and finely ground process intermediate, which contains at least one or more valuable non-ferrous sulphide minerals with iron sulphides in an aqueous alkaline slurry in the presence of a collector, a frother, a pH modifier, a carrier gas distributed through the slurry, and multiple depressants selected to include at least one organic polymer, at least one sulphur-containing compound, and at least one nitrogen-containing organic compound; and ii) Carrying out froth flotation to depress the iron sulphides, while allowing the flotation of the at least one or more valuable non-ferrous sulfide minerals.

2. The method according to claim 1, wherein said at least one or more valuable non-ferrous sulphide minerals are at least one of pentlandite and millerite, chalcopyrite and chalcocite and bornite, galena or sphalerite or a mixture thereof, a freshly ground ore or pretreated intermediate streams.

3. The method according to claim 1, wherein said at least one or more nonferrous sulfide minerals are selected from the group of nickel, copper, zinc and lead, cobalt, platinum, palladium, gold and silver part of sulphide mineral.

4. The method according to claim 1, wherein said iron sulphides are pyrrhotite, pyrite and marcasite or a mixture thereof.

5. The method according to claim 1, wherein the said aqueous alkaline slurry has a pH of between about 8 and 12.

6. The method according to claim 1, wherein the said aqueous alkaline slurry has a pH of 9.5.

7. The method according to claim 1, wherein the said collector is at least one of xanthate, dithiophosphate, thionocarbamate, dithiocarbamate, dithiophosphinate, xanthogen formates, xanthic esters or a mixture thereof.

8. The method according to claim 7, wherein the said collector is xanthate.

9. The method according to claim 1, wherein the said carrier gas is selected from the group consisting of at least one of air, nitrogen, nitrogen-enriched air or oxygen-enriched air or carbon dioxide (enriched air) or a mixture thereof.

10. The method according to claim 9, wherein the said carrier gas is air.

11. The method according to claim 1, wherein the said nitrogen-containing organic compound is at least one of nitrogen-containing organic compound having a configuration selected from the group consisting one of or more polyethylene-polyamines with OCNCCCNCNC and NCCN structures, or a mixture thereof, including diethylenetriamine, triethylenetetramine, tetraethylenepentamine, pentaethylenehexamine, hydroxyethyl-DETA, diethanolamine, and aminoethylethanolamine.

12. The method according to claim 11, wherein the said nitrogen-containing organic compound is DETA (diethylenetriamine).

13. The method according to claim 1, wherein the said sulphur-containing compound is at least one of water-soluble inorganic sulphur-containing compound selected from the group consisting of one or more sulphides, sulphites, hydrosulphites, meta-bisulphates, dithionates, tetrathionates, sulphur dioxide, or a mixture thereof.

14. The method according to claim 13, wherein the said sulphur-containing compound is a sulphite.

15. The method according to claim 1, wherein the said organic polymer is at least one water-soluble organic negatively charged polymer selected from the group consisting of one or more hardwood lignosulphonates, dextrin, guar gum, tapioca, starch, or cellulose.

16. The method according to claim 15, wherein the said organic polymer is calcium lignosulphonate from hardwood with 6 kDa molecular weight, and containing about 5% sulphonate and about 2% sugar.

17. The method according to claim 1, wherein the optimum dosage for each depressant is experimentally determined for each sulphide ore.

18. The method according to claim 1, wherein the nitrogen-containing organic compound is present in the mixture at lesser amounts than would be needed if it was being used alone or in combination with the sulphur-containing compound.

19. The method according to claim 1, wherein the multiple depressants can be added separately at the same time.

20. The method according to claim 1, wherein the multiple depressants can be added sequentially without particular order.

21. The method according to claim 1, wherein the multiple depressants can be added as a pre-mixed single solution with a determined preferential ratio of each component.

22. The method according to claim 1, wherein the multiple depressants can be added as a premixed single solution with two of the components at a determined preferred ratio, and the third component added separately in varying amounts as needed.

* * * * *